US006024632A

United States Patent [19]

Mizuno et al.

[11] Patent Number: 6,024,632

[45] Date of Patent: Feb. 15, 2000

[54] GRINDING METHOD USING GRIT STUCK TO A TOOL HAVING LOW HARDNESS

[75] Inventors: Sadao Mizuno, Nagoya; Akinori Hoshino, Toyota; Tetsuya Morita, Gamagori; Satoru Shibata, Okazaki, all of Japan

[73] Assignee: Aisin Seiki Kabushiki Kaisha, Kariya, Japan

[21] Appl. No.: 08/938,152

[22] Filed: Sep. 26, 1997

[30] Foreign Application Priority Data

Sep. 26, 1996 [JP] Japan ..... 8-254995
Sep. 25, 1997 [JP] Japan ..... 9-259556

[51] Int. Cl.[7] ..... B24B 5/04; B24B 57/02

[52] U.S. Cl. ..... 451/56; 451/60; 451/446; 451/49

[58] Field of Search ..... 451/56, 60, 446, 451/28, 49, 443; 125/11.01

[56] References Cited

U.S. PATENT DOCUMENTS 0,420,243 1/1890 Niland ..... 451/446
1,097,565 5/1914 Straubel ..... 451/41
2,332,133 10/1943 Dayton ..... 451/65
4,068,416 1/1978 Bonnice ..... 125/11.01
5,094,671 3/1992 Hall et al. ..... 51/293

FOREIGN PATENT DOCUMENTS 2116085 9/1983 United Kingdom ..... 125/11.01

*Primary Examiner*—Robert A. Rose
*Attorney, Agent, or Firm*—Oblon, Spivak, McClelland, Maier & Neustadt, P.C.

[57] ABSTRACT

A grinding method includes a grit sticking step and a grinding step. In the grit sticking step, grit particles are stuck in a first tool by contacting the first tool with a second tool which is harder than the first tool, rotating the first tool and the second tool, and feeding the grit to the contacting surface between the first tool and the second tool. In the grinding step, the workpiece is ground by contacting the first tool with the workpiece and rotating the first tool or the workpiece.

6 Claims, 5 Drawing Sheets

GRINDING METHOD USING GRIT STUCK TO A TOOL HAVING LOW HARDNESS

BACKGROUND OF THE INVENTION

Field of the Invention

The present invention relates to a method for grinding. More particularly, it relates to a method for grinding by sticking grit to a tool having low hardness.

Discussion of the Background Art

Referring to FIG. 8, it is known to grind the entire outer cylindrical surface of a workpiece 2 by contacting the same with the outer cylindrical surface of a hone 1 having grit particles bonded to the cylindrical surface thereof by use of a bonding material. The cylindrical hone 1 is rotated and moved in the axial direction. The hone 1 is composed of a resin or metal bonding material and an $Al_2O_3$ or Cubic Boron Nitride grit. The workpiece 2 is ground by contacting with the grit of the hone 1.

But the grit may separate from the bonding material or be ground down when the hone is used for a certain time, in which case the workpiece 2 will not have a fine surface finish. It is therefore necessary to grind the bonding material on the surface of the hone using a dresser made of a high hardness element such as diamond, to project grit from the surface of the hone 1 and to assure a fine surface finish of the workpiece 2. But grit particles projected by the dresser are wasted and the position of the workpiece 2 or the hone 1 has to be adjusted due to the change in the size of the hone 1. This increases manufacturing time.

SUMMARY OF THE INVENTION

It is, therefore, an object of the present invention to provide a method of grinding which overcomes the above drawbacks.

In order to achieve the above and other objects, there is provided a grinding method which comprises a grit sticking step and a grinding step. In the grit sticking step, grit particles are stuck in a first tool by contacting the first tool with a second tool which is harder than the first tool, rotating the first tool and the second tool, and feeding grit particles to the contacting surface between the first tool and the second tool. In the grinding step, the workpiece is ground by contacting the first tool with the work and rotating the first tool or the workpiece.

BRIEF DESCRIPTION OF THE DRAWINGS

Additional objects and advantages of the present invention will become more apparent from the following detailed description of a preferred embodiment thereof when considered with reference to the attached drawings, in which.

DESCRIPTION OF THE PREFERRED EMBODIMENTS

Figure 1:
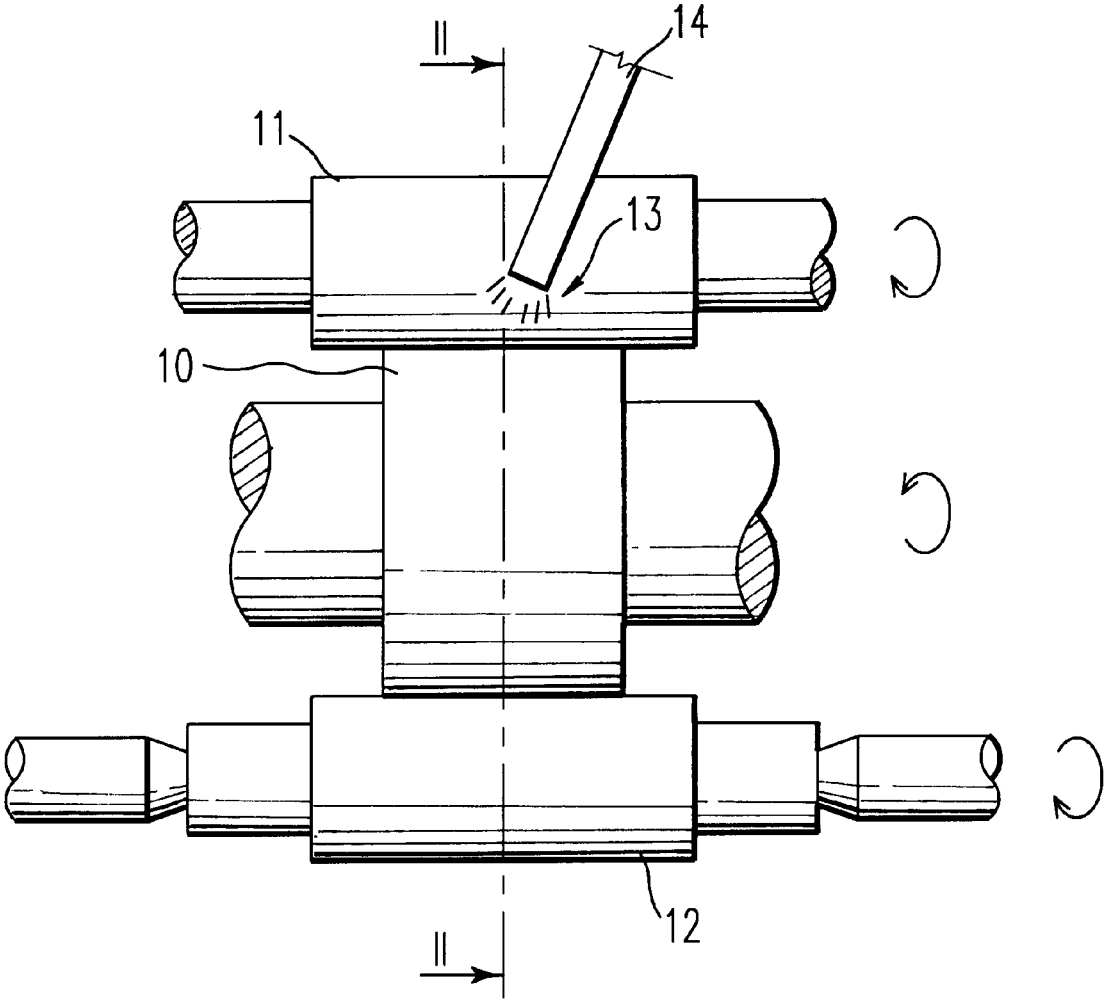
FIG. 1 shows a method for grinding according to a first embodiment of the present invention.
Figure 2:
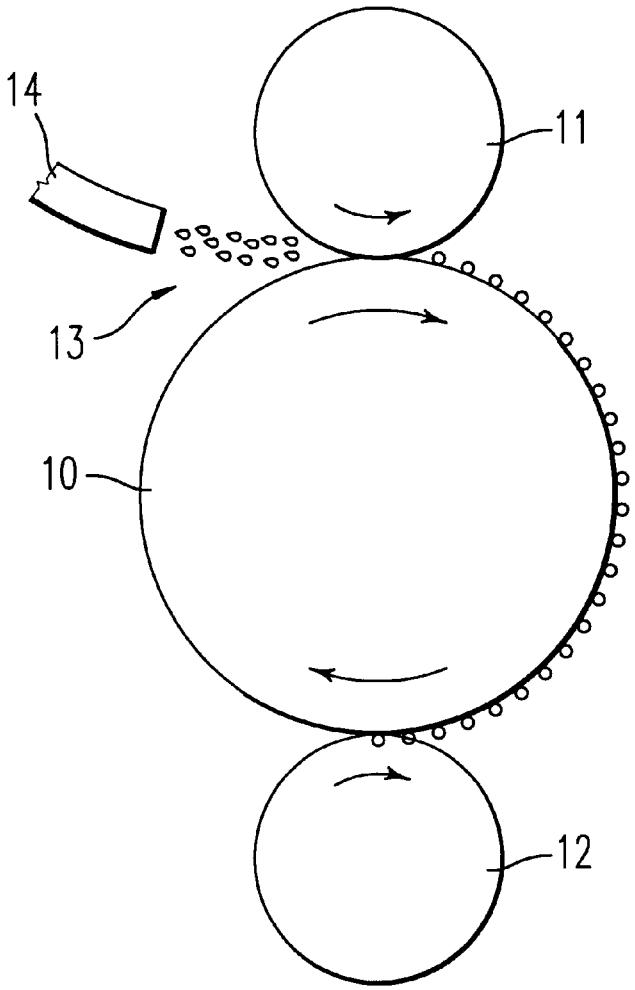
FIG. 2 is a cross section along line I–II of FIG. 1.

Referring to the non-limiting embodiment of FIGS. 1 and 2, a first tool 10 is made of resin or rubber and has a cylindrical shape. A second tool 11 is made of metal and has a cylindrical shape whose diameter is smaller than that of the first tool 10. A workpiece 12 is made of metal and has a cylindrical shape whose diameter is smaller than that of the first tool 10. $Al_2O_3$ or Cubic Boron Nitride grit particles 13 are fed from a nozzle 14 of a grit feeding device 15.

The grinding method of the invention includes a grit sticking step and a grinding step. The grit sticking step sticks the grit 13 into the surface of the first tool 10. The grinding step grinds the surface of the workpiece 12 using the stuck grit. In the grit sticking step, grit particles 13 are stuck into the first tool 10 at the contacting surface between the first tool 10 and the second tool 11 by contacting the first tool 10 with the second tool 11, feeding the grit 13 from the nozzle 14 and rotating the first tool 10. In the grinding step, the cylindrical surface of the workpiece 12 is ground by contacting the cylindrical surface of the first tool 10 with the cylindrical surface of the workpiece 12 and rotating the first tool 10 and the workpiece 12.

The second tool 11 is harder than the first tool 10, and the grit 13 is harder than the second tool 11. Accordingly, the grit 13 which is fed to the contacting surface between the second tool 11 and the first tool 10 is stuck in the first tool 10. The grit stuck to the first tool 10 grinds the workpiece.

In the first embodiment, grit 13 is stuck into the first tool 10 by contacting the first tool with the second tool 11, and the first tool 10 contacts the workpiece 12. Therefore, the grit sticking step and the grinding step are performed at the same time, and the manufacturing time can be reduced.

Figure 3:
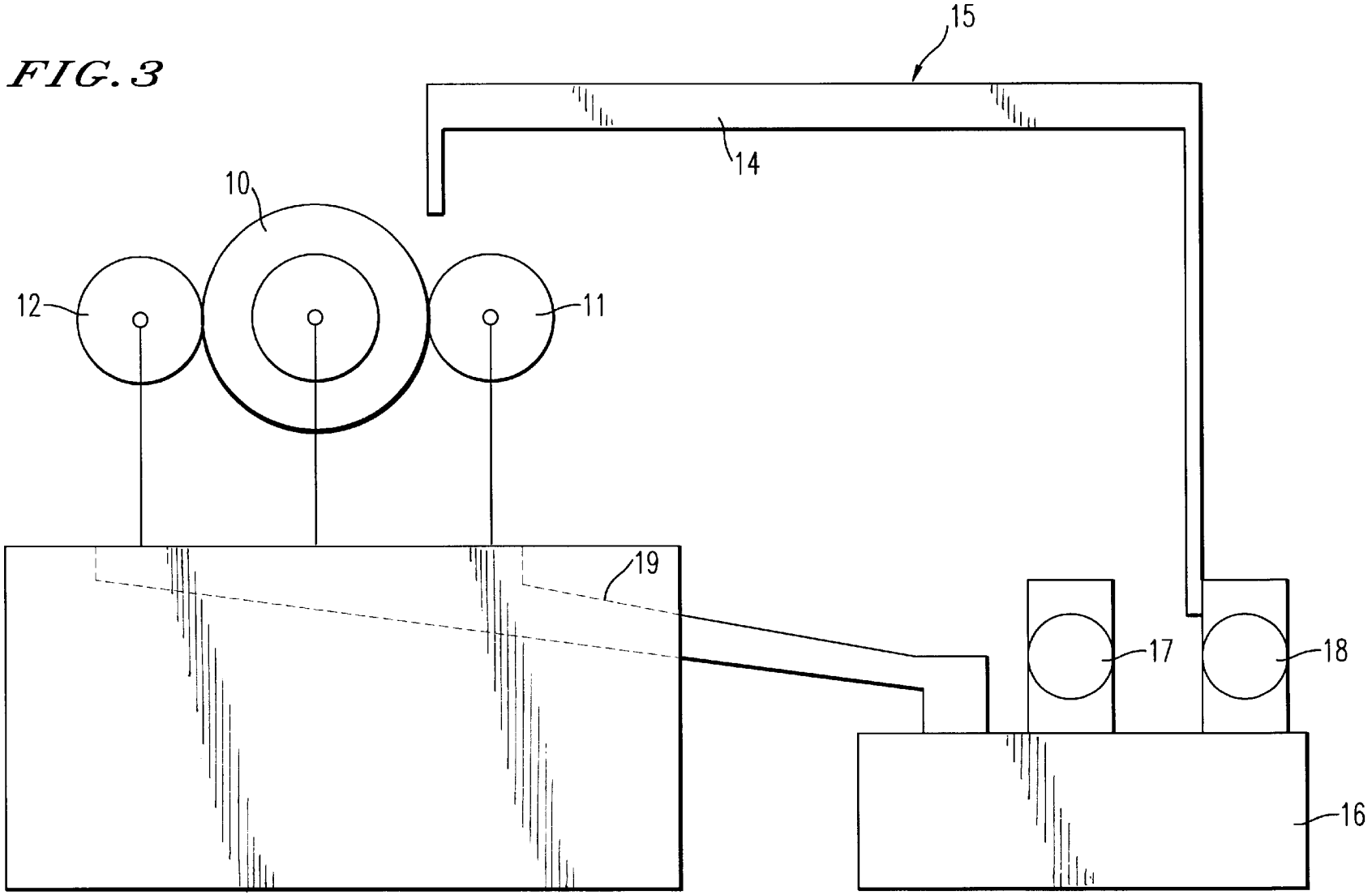
FIG. 3 shows a grit feeding device of the first embodiment of the present invention.

FIG. 3 shows the grit feeding device 15. The grit feeding device 15 is comprised of a storage case 16 for storing grit 13, a stirring motor 17 for stirring the grit 13 in the storage case 16, a pump 18 for pumping out the stirred grit 13, the nozzle 14 for feeding grit particle 13 to the contacting surface between the second tool 11 and the first tool 10, and a grit collecting system 19 for collecting grit particles 13 and sending them back to the storage case 16. Grit 13 stored in the storage case 16 is mixed with oil by operation of the stirring motor 17 and pumped out by the pump 18. Grit 13 is fed from the nozzle 14 to the contacting surface between the second tool 11 and the first tool 10. In the grit feeding device 15 shown in FIG. 3, the grit collecting system 19 collects grit 13 coming off from the first tool 10 during the grit sticking step to prevent the grit 13 from being wasted.

Figure 4:
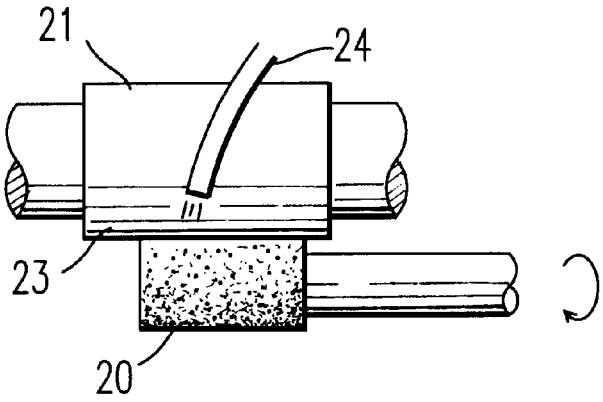
FIG. 4 shows a grit sticking step of a second embodiment of the present invention.
Figure 5:
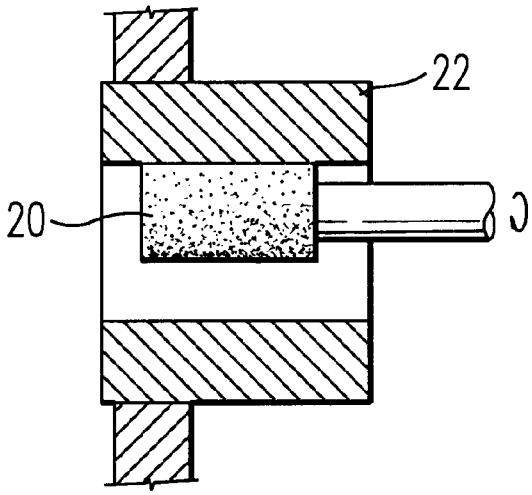
FIG. 5 shows a grinding step of the second embodiment.
Figure 8:
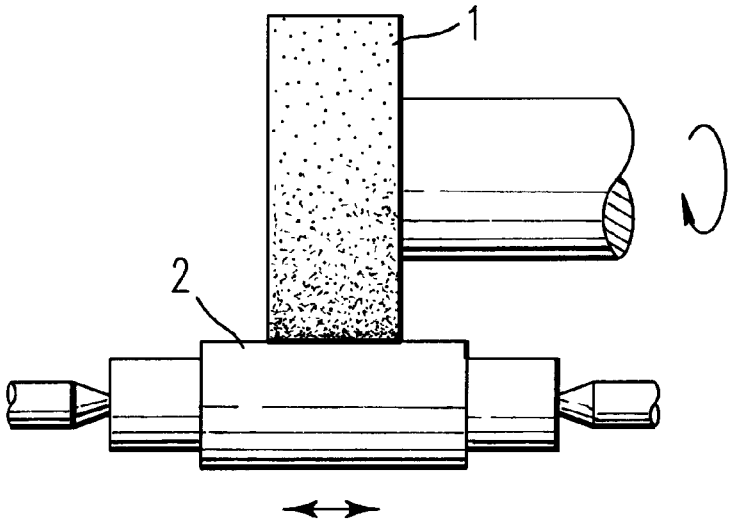
FIG. 8 shows a conventional method for grinding.

FIG. 4 and FIG. 5 show the grinding step of the second embodiment. In the second embodiment, a workpiece 22 is shaped as a hollow cylinder and the inner surface of the workpiece 22 is ground by a first tool 20. In this embodiment, because the first tool 20 grinds the inner surface of the workpiece 22, it is impossible to perform a grit sticking step and a grinding step at the same time. As shown in FIG. 4, grit particles 23 are stuck in the surface of the first tool 20 by feeding the grit to the contacting surface between the first tool 20 and a second tool 21. After the grit sticking step, as shown in FIG. 5, the inner surface of the workpiece 22 is ground by contacting the outer surface of the first tool 20 and the inner surface of the workpiece 22, and rotating the first tool 20. It is not necessary to adjust the position of the workpiece 22 and the first tool 20 in the grinding step because the size of the first tool 20 does not change even if the grinding step is performed for a long time.

In the second embodiment, the grit feeding device is the same as in the first embodiment, so an explanation of the grit feeding device is omitted.

Figure 6:
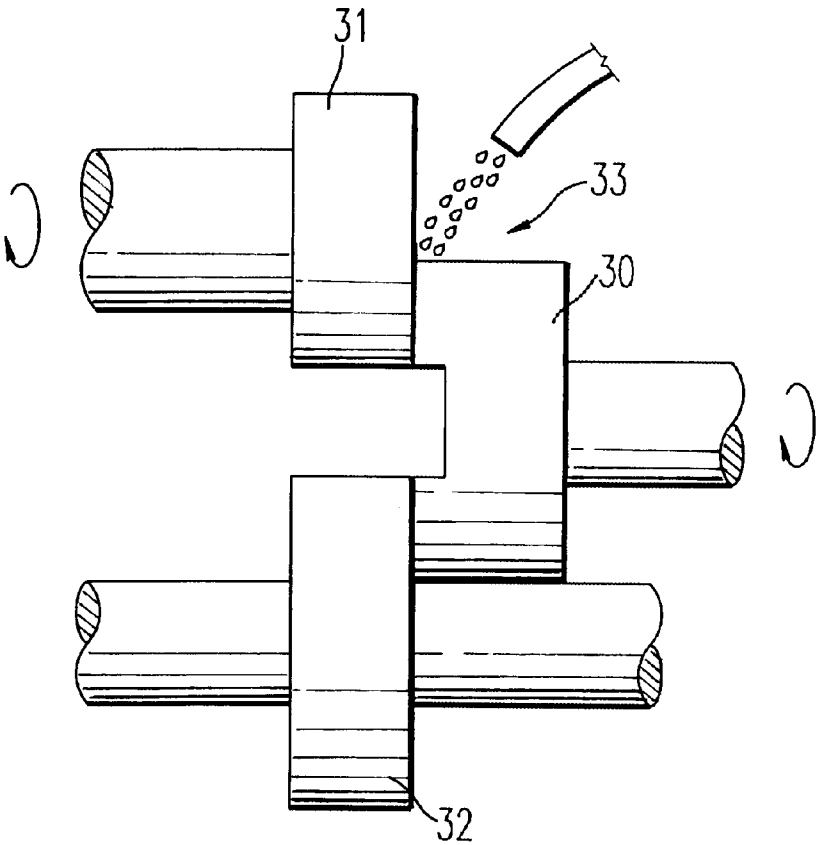
FIG. 6 shows a method of grinding according to a third embodiment of the present invention.

FIG. 6 shows the third embodiment in which an axial end surface of the cylindrical workpiece 32 is ground. Grit 33 is stuck in the axial end surface of the first tool 30 by feeding the grit 33 to the contacting surface between the axial end surface of the first tool 30 and the axial end surface of the second tool 31, and rotating the first tool 30 and the second tool 31. The axial end surface of the first tool 30 contacts the axial end surface of the workpiece 32, the axial end surface of the workpiece 32 is ground by rotating the first tool 30 and the workpiece 32.

In the third embodiment, the grit feeding device is the same as in the first embodiment so an explanation of the grit feeding device is omitted.

Figure 7:
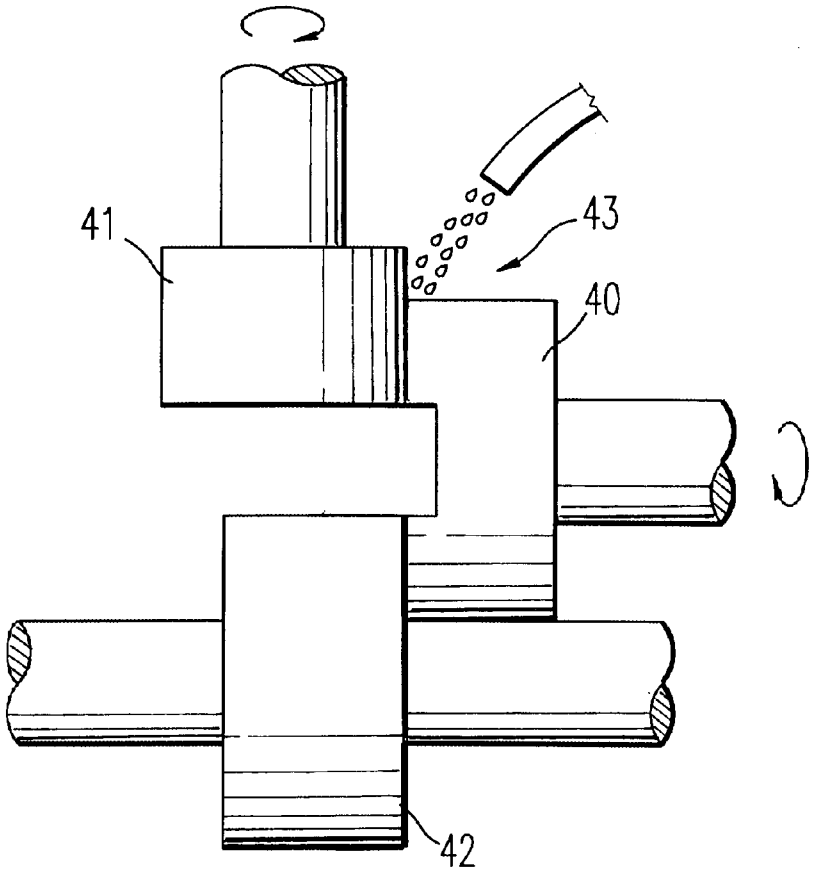
FIG. 7 shows a method of grinding according to a fourth embodiment of the present invention.

FIG. 7 shows the fourth embodiment in which an axial end surface of the cylindrical workpiece 42 is ground, but the grit sticking step is different from that in the third embodiment. Grit is stuck in the axial end surface of the first tool 40 by feeding grit particle 43 to the contacting surface between the axial end surface of the first tool 40 and the cylindrical surface of the second tool 41, and rotating the first tool 40 and the second tool 41. The axial end surface of the first tool 40 contacts the axial end surface of the workpiece 42, the axial end surface of the workpiece 42 is ground by rotating the first tool 40 and the workpiece 42.

In the fourth embodiment, the grit feeding device is the same as that in the first embodiment, so an explanation of the grit feeding device is omitted.

The above described embodiments are directed to grinding surfaces of a cylindrical workpiece. But the workpiece can have other shapes, such as a conical shape.

The principles of the invention have been described with reference to embodiments of the invention in the foregoing description. The invention which is intended to be protected herein should not, however, be construed as limited to the particular forms disclosed, as these are to be regarded as illustrative rather then restrictive. Variations and changes may be made by those skilled in the art without departing from the spirit of the present invention. Accordingly, the foregoing detailed description should be considered exemplary in nature and not limiting of the scope and spirit of the invention as set forth in the appended claims.

What is claimed as new and desired to be secured by letters patent of the United States is:

1. A grinding method comprising:

a grit sticking step of sticking grit to a first tool by contacting the first tool with a second tool which is harder than the first tool and feeding grit to a contacting surface between the first tool and the second tool which are in rotation; and a grinding step of grinding a workpiece by contacting the first tool having the grit stuck thereto with the workpiece and rotating the workpiece.

2. The method of claim 1 wherein the grit sticking step and the grinding step are performed at the same time by contacting the first tool with the second tool and with the workpiece.

3. The method of claim 1, wherein the grit sticking step is performed before the grinding step.

4. The method of claim 1, wherein at least one of the first tool, the second tool and the workpiece is cylindrical in shape.

5. The method of claim 1, wherein at least one of the first tool, the second tool and the workpiece is conical in shape.

6. The method of claim 1, wherein said first tool is made of rubber or a resin and second tool is made of metal.

* * * * *